United States Patent [19]

Dornier

[11] 4,446,632

[45] May 8, 1984

[54] DRYING EQUIPMENT FOR TUBULAR TEXTILE WARES

[75] Inventor: Peter Dornier, Lindau, Fed. Rep. of Germany

[73] Assignee: Lindauer Dornier Gesellschaft mbH, Fed. Rep. of Germany

[21] Appl. No.: 320,739

[22] Filed: Nov. 12, 1981

[30] Foreign Application Priority Data

Dec. 24, 1980 [DE] Fed. Rep. of Germany ..... 3048957

[51] Int. Cl.[3] ..... F26B 25/00

[52] U.S. Cl. ..... 34/103; 34/104; 26/81; 26/85; 68/20

[58] Field of Search ..... 34/104, 103; 26/81, 26/85; 68/13 R, 20

[56] References Cited

U.S. PATENT DOCUMENTS

| | | | |
|---|---|---|---|
| 3,257,735 | 6/1966 | Catallo | 34/158 |
| 4,266,983 | 5/1981 | Laszlo et al. | 26/81 |
| 4,269,046 | 5/1981 | Strahm et al. | 68/13 R |
| 4,337,630 | 7/1982 | Strahm | 68/13 R |

FOREIGN PATENT DOCUMENTS 694499 7/1953 United Kingdom .

*Primary Examiner*—Larry I. Schwartz
*Assistant Examiner*—David W. Westphal
*Attorney, Agent, or Firm*—James E. Bryan

[57] ABSTRACT

This invention relates to an improvement in drying equipment for tubular textile ware comprising a vertically floating circular expander adapted to spread the tubular ware from the inside, with drying air being blown from the outside into the tubular ware inside in a first zone and evacuated from the inside to the outside in an adjacent second zone, the improvement which comprises (a) three zones consecutive in the direction of motion of the ware, the zones being mutually bounded by a partition transverse to the direction of motion of the ware and surrounding the circular expander, and being located in the area of an entry part spreading the tubular ware and a corresponding exit part, (b) the zone located between the entry part and the exit part being designed as a suction chamber and the outer zones being designed as blowing chambers, and (c) the entry part and the exit part including axial flow openings for the drying air.

5 Claims, 2 Drawing Figures

DRYING EQUIPMENT FOR TUBULAR TEXTILE WARES

This invention relates to drying equipment for tubular textile wares, with a circular expander maintained vertically floating and spreading the tubular ware from the inside thereof, and with drying air being blown from the outside into the tubular inside in a first zone and being evacuated from the inside to the outside in an adjacent second zone.

In the course of finishing tubular wares, these wares at the present time usually are cut open for the drying process or are dried in the flat folded state in clip tenters. However, the cutting open of the tubular ware is undesirable for most subsequent processing and should be avoided. When the tubular ware is dried in the flat, folded state, fold marks are generated which not only detract from the appearance of the ware but also constitute a drawback for further processing.

German Patent No. 913,283 discloses a drying system for tubular textile wares, wherein the tubular ware is not cut open. It is pulled vertically over a freely floating circular expander and exposed to dry air in the process. The circular expander is located within a cylindrical drying housing comprising a sealing plate at the top and bottom which is provided with an aperture approximately fitted to the diameter of the circular expander. The circular expander itself consists of a cage-like cylindrical structure over which the tubular ware is pulled. When the ware is inserted, the uppermost ring of a number of reinforcing rings of the circular expander rests on a ring of the upper sealing plate of the housing and is held in this manner. The tubular ware is guided from below over the circular expander and, on account of friction, somewhat raises the expander during its motion, whereby the circular expander is kept floating within the tubular ware. The housing surrounding the circular expander furthermore comprises a partition positioned transversely to the direction of motion of the ware between the two sealing plates and dividing the housing into two chambers. The dry air is supplied to the upper chamber. It passes through the wall of the tubular ware and then flows down within the tubular ware where, in the lower chamber, it crosses the wall of the tubular ware a second time and in this instance from the inside to the outside, then being evacuated, or following heating being recirculated for drying again. A disk preventing the discharge of the drying air within the tubular ware in the downward direction is provided at the lower end of the circular expander approximately at the height of the lower sealing plate of the housing.

This known apparatus has the drawback that in its motion, the tubular ware must overcome the friction of all the reinforcing rings of the circular expander and that, moreover, it must yet support the weight of the circular expander. Accordingly, substantial tensional forces are generated in the tubular ware, whereby it experiences a more than trivial longitudinal stress. On the other hand, there is a requirement for the least possible tensions because the residual shrinkages of the ware should be minimized.

Another circular expander is known from German Auslegeschrift No. 2,848,409, which can be used when wet-treating tubular wares, in particular for use in mercerizing or caustic soda treatment machines. This circular expander also is cylindrical in shape and consists of two entry and exit parts tapering toward their ends and seated on a central and vertically mounted support. Radially spreading, elongated longitudinal guide elements, shaped like arcs of a circle in cross-section, for the tubular ware are mounted between the entry and exit parts. In this case also the tubular ware must overcome friction because it rests against the longitudinal guide elements. The weight of the circular expander is borne by rollers which are adapted in their contour to the shape of the tapered bodies and which simultaneously center the circular expander. For weight relief, the bodies can be designed as floaters and may provide a hydrostatic buoyancy by being dipped into the bath of the treatment liquid.

While a tension in the tubular ware is required when liquid-treating it, the conditions are different for dry processes. Inherently, the expander cannot be dipped into a liquid because the tubular ware already is partly dehydrated when arriving at the drier. Moreover, the drying process on one hand should take place under tension in the radial direction—corresponding to the tenter spreading effect—; however, as already mentioned above, as regards the direction of motion of the ware, the tension should be minimized on account of the residual shrinking. Again, the known circular expander is less suited for good and quick drying because the longitudinal elements over their entire length and width lie on the inside against the ware and hence the drying air will not be optimally introduced.

Accordingly, the friction represents an essential problem in drying equipment for tubular wares using floating circular expanders. The friction between the tubular ware and the circular expander is generated predominantly at the entry part of the circular expander, where the ware in the flat, folded state is spread into the tubular shape, and also where the expander rests or is guided on a ring or annular support and transport rollers.

It is therefore the object of the invention to reduce or eliminate the friction between the ware to be dried and the expander while on the other hand making possible an unhampered flow of air through the ware. Not only should the longitudinal tension in the ware be maintained low, but also a constant and adequate transverse tension should always be present.

Starting from the drying equipment described in the above cited German Patent No. 913,283, and comprising a housing divided into blowing and suction zones and a circular expander kept floating therein, the problem is solved by the invention in that:

(a) three zones are provided sequentially in the direction of motion of the ware which are mutually bounded by a partition surrounding the circular expander and always located in the area of an entry part expanding the tubular ware and a corresponding exit part of the circular expander, and arranged transversely to the direction of motion of the ware;

(b) the zone between the entry part and the exit part is designed as the suction chamber and the outside zones as blowing chambers, and (c) the entry part and the exit part comprise axial passageways to allow the drying air to flow through.

Advantageously, the circular expander is composed of annular entry and exit parts connected together by a central support and already offering large flow openings because of their annular shape. The external contour of the entry and exit parts is conical and the partitions surrounding these parts evince a correspondingly shaped wall surface. The circular expander is composed of a few light components causing only minimal friction. The drying air without any impediment can pass twice through the wall of the tubular ware, namely in the two outer zones (blowing zones) from the outside to the inside and in the center zones (suction zone) from the inside to the outside. The tubular ware assumes the sealing between the partition and the entry or the exit part. The longitudinal tension in the tubular ware is low, yet the radial tension required for drying in the significant center part is present because of bulging the tubular ware by means of the air flow.

In another advantageous embodiment of the invention, means are provided at least on one of the partitions which keep the circular expander floating magnetically. To that end, at least the lower annular part of the circular expander is provided with an annular mass of iron or a permanent magnet, while an annular magnet is mounted outside the path of the ware in lieu of annular support rollers. A repelling effect can be exerted on the circular expander by an appropriate polarity of the magnetic components and hence the circular expander can be kept floating. In this manner a stable gap of conical shape is formed between the partition and the annular part of the expander, permitting clear and frictionless passing of the tubular ware. As a gap of only a few millimeters is sufficient for passing the tubular ware, the required magnetic repulsion can be obtained without any problems. If in lieu of a permanent magnet as the outer ring an electromagnet is used, the gap formed can even be adjusted by controlling this electromagnet.

If required, a magnetic support system can be mounted at the upper end of the circular expander in a similar manner. In some cases an arrangement of magnetic components in the partition, i.e., in the circular expander, however, will suffice, using known magnetic bearings, by means of which the expander position can be stabilized and centered.

In lieu of closed iron or magnetic rings in the entry or exit part of the expander, the design also may be such that only parts of the ring are composed of a magnetic material and are completed into a full ring by non-magnetic parts.

One embodiment of the invention is illustrated below with reference to the accompanying drawings, in which.

Figure 1:
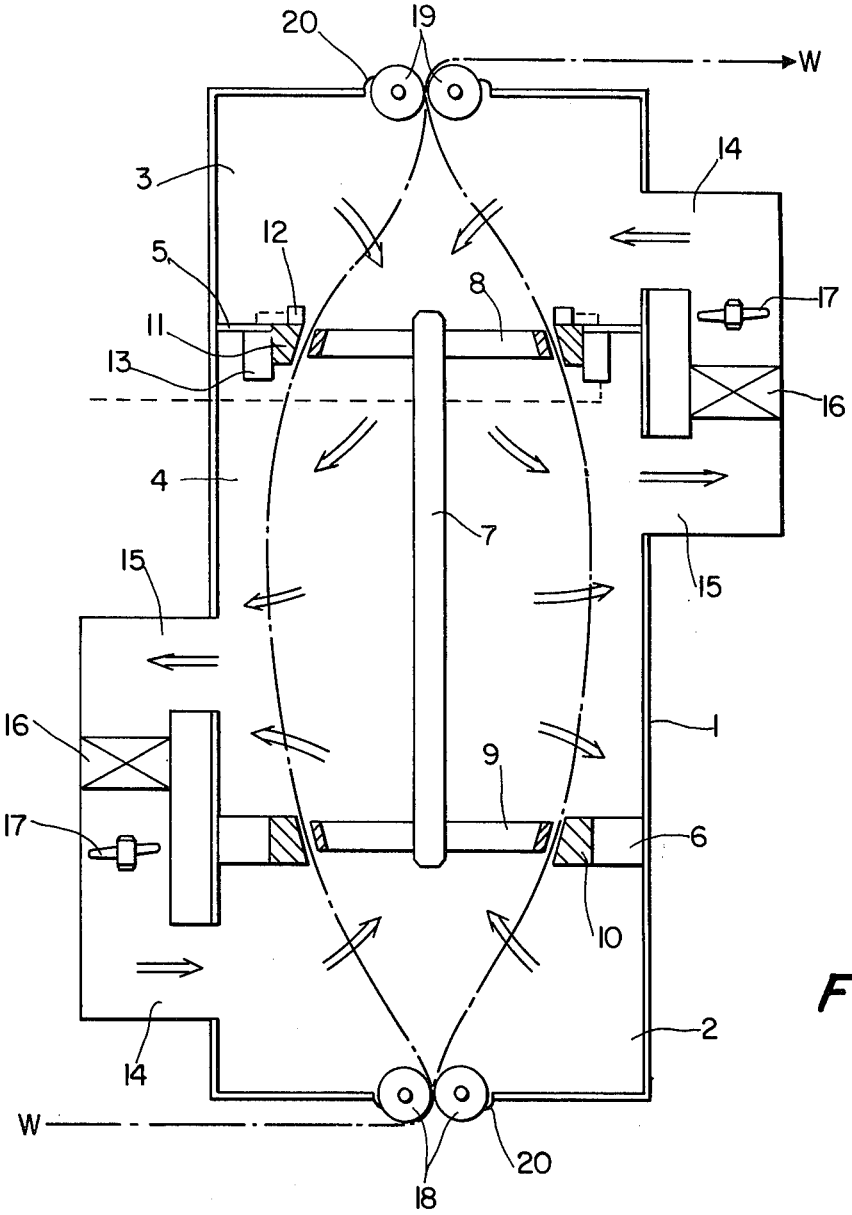
FIG. 1 is a schematic longitudinal section of a drying apparatus.

FIG. 1 shows, in a much simplified form, a drying apparatus using a circular expander. The equipment is composed of a housing 1 to which the tubular ware W moving in the direction of the arrow and indicated by dash-dot lines is guided from below and by means of intake rollers 18. Inside the housing, the ware W is transformed from the flat-folded state into a spread-open one. This is performed by a circular expander by means of its entry part 9. After it leaves the upper end of the circular expander, that is beyond the exit part 8, the ware is laid flat again and removed through the exit rollers 19. Seals 20 are advantageously provided at the intake and exit rollers to prevent, as much as possible, a loss of drying air from the housing 1.

The circular expander mounted within the housing 1 is composed of a central support 7 to the ends of which are mounted an entry part 9 and an exit part 8. The entry and exit parts can be designed for instance as disks and include passageways for the axial flow of air therethrough. Advantageously however the entry and exit parts 9 and 8 respectively are designed in the shape of rings held in place by the central support 7, for instance by means of a spider. The outer contour of the annular entry and exit parts 9 and 8 respectively is conical.

Figure 2:
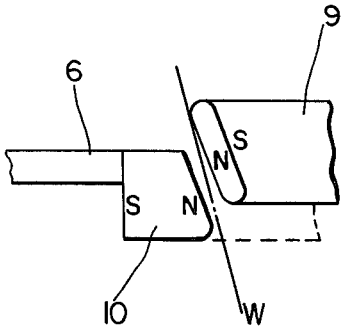
FIG. 2 is an enlargement of the gap between the partition and the circular expander.

The housing 1 is divided by two partitions 5 and 6 which are arranged in such a manner that with the entry and exit parts 9 and 8 respectively of the circular expander they are together located essentially in one plane. The partitions 5 and 6 each include an opening to receive the entry and exit parts 9 and 8 respectively. The opening in the partitions is bounded by rings with conical wall surfaces. The conical shape is fitted to that of the entry and exit parts 9 and 8 respectively. In this manner as regards for instance the entry part 9 and the partition ring 6 surrounding it, a conical annular gap with an upwardly increasing diameter is achieved. First the partition 6 and the lower part of the expander, that is the entry part 9, will be considered. The opening of the partition 6 is bounded by an annular permanent magnet or electromagnet 10 with a conical surface. Opposite the magnet is located the entry part 9, which is also an annular magnet For the polarity for instance shown in FIG. 2, a magnetic repulsion is generated which keeps the expander floating and results in forming the air gaps so the ware can pass therethrough.

Together with the associated upper part of the circular expander, that is the exit part 8, the upper partition 5 can be constructed in the same manner. For instance an upwardly flaring conical gap again may be provided, whereby the upper arrangement also can act as a support magnet for the expander. However, it is assumed in FIG. 1 that an annular magnet 11 is mounted in the plane of the partition 5 at the edge of the opening, the magnet together with an exit part 8 being designed as an annular magnet centering and stabilizing the expander at its upper end on account of magnetic repulsion. The entire weight of the expander in this case is supported by the support magnet arrangement 10 in the plane of the partition 6 alone. The upper expander end also can be stabilized in known manner with magnetic bearings and only indicated here in the drawing. Thus a gap sensor 12 is provided in the plane of the partition 5 which actuates an electric regulating means 13 which in turn acts on the electromagnetic ring 11. The design of the electromagnet 11 may be varying, for instance various controlled individual magnets might be distributed on the circumference thereof, or a correspondingly designed toroidal coil may be used. The electric control lines of these regulation circuits are indicated by dashed lines in FIG. 1.

As already mentioned, three zones are formed by the partitions 5 and 6 in the housing 1, namely the two end zones 2 and 3 located at the entry and exit respectively, and the center zone 4. The three zones communicate with each other not only by the feed-through or annular entry and exit parts 9 and 8 respectively of the expander, but also by means of ducts of air conveying means outside the housing. These paths always are composed of a suction duct 15 beginning at the center zone 4 and a blowing duct 14 issuing in the end zone 2 or 3. Also, a heating system 16 and a blower 17 to heat and move the drying air is inserted into the outside communicating means.

In the drying process, drying air is blown from the blowing ducts 14 in the direction of the double arrows into the two outer zones 2 and 3. In the outer zone 2, the drying air during the spreading of the tubular ware penetrates between the intake rollers 18 and the lower part, that is the entry part 9 of the expander and passes through the ware wall into the inside of the ware. The air then passes through the flow openings of the entry part 9 and moves further inside into the center zone 4. In a corresponding manner and during the laying-flat of the ware between the exit part 8 and the exit rollers 19, air passes into the ware inside and then also into the center zone 4. In the zone 4, that is in the most important zone of the drier, the tubular ware wall is traversed by the drying air from the inside to the outside. In the process, the tubular ware is inflated and thereby receives the required transverse tension. The tubular ware moves completely freely and without any mechanical guide elements in the center zone 4. Accordingly, the drying air can flow through the ware everywhere and without impediments. Due to the weight relief at the entry part of the magnetically supported expander, the longitudinal tension in the ware is minimal, being due only to the slight residual friction between the tubular ware and the relatively narrow rings of the entry and exit parts 9 and 8 respectively. Excellent drying is achieved because the drying air passes three times through the wall of the tubular ware.

Lastly, the entry and exit parts may deviate from the conical shape. It is essential only to generate a magnetic supporting force for the circular expander and, for instance when using electromagnets, the circular expander can rest on a housing-fixed component in case the magnetic force should be shut off.

It will be obvious to those skilled in the art that many modifications may be made within the scope of the present invention without departing from the spirit thereof, and the invention includes all such modifications.

What I claim is:

1. In drying equipment for tubular textile ware comprising a vertically floating circular expander adapted to spread the tubular ware from the inside, with drying air being blown from the outside into the tubular ware inside in a first zone and evacuated from the inside to the outside in an adjacent second zone, the improvement which comprises (a) three zone means consecutive in the direction of motion of the ware, said zone means being mutually bounded by partition means transverse to the direction of motion of the ware and surrounding the circular expander, and being located in the area of an entry part of said expander spreading the tubular ware and a corresponding exit part of said expander, each of said entry and exit parts being in a substantially common plane with an associated partition means, (b) magnetic means, adapted to keep the circular expander floating, at least at one of said partition means, (c) the zone means located between the entry part and the exit part being designed as a suction chamber and the outer zone means being designed as blowing chambers, and (d) the entry part and the exit part including axial flow openings for the drying air.

2. In drying equipment for tubular textile ware comprising a vertically floating circular expander adapted to spread the tubular ware from the inside, with drying air being blown from the outside into the tubular ware inside in a first zone and evacuated from the inside to the outside in an adjacent second zones, the improvement which comprises (a) three zone means consecutive in the direction of motion of the ware, said zone means being mutually bounded by partition means transverse to the direction of motion of the ware and surrounding the circular expander, and being located in the area of an entry part of said expander spreading the tubular ware and a corresponding exit part of said expander, each of said entry and exit parts being in a substantially common plane with an associated partition means, (b) the zone means located between the entry part and the exit part being designed as a suction chamber and the outer zone means being designed as blowing chambers, and (c) the entry part and the exit part including axial flow openings for the drying air, said entry and/or exit part being composed at least partially of a magnetic material, and supporting magnets and/or stabilizing magnets mounted in said partition means surrounding said entry and/or exit parts.

3. In drying equipment for tubular textile ware comprising a vertically floating circular expander adapted to spread the tubular ware from the inside, with drying air being blown from the outside into the tubular ware inside in a first zone and evacuated from the inside to the outside in an adjacent second zone, the improvement which comprises (a) three zone means consecutive in the direction of motion of the ware, said zone means being mutually bounded by partition means transverse to the direction of motion of the ware and surrounding the circular expander, and being located in the area of an entry part of said expander spreading the tubular ware and a corresponding exit part of said expander, each of said entry and exit parts being in a substantially common plane with an associated partition means, (b) the zone means located between the entry part and the exit part being designed as a suction chamber and the outer zone means being designed as blowing chambers, and (c) the entry part and the exit part including axial flow openings for the drying air,said entry and/or exit part being composed at least partially of a magnetic material, and supporting magnets and/or stabilizing magnets mounted in said partition means surrounding said entry and/or exit parts, said supporting magnets being adapted to operate on the principle of magnetic repulsion.

4. In drying equipment for tubular textile ware comprising a vertically floating circular expander adapted to spread the tubular ware from the inside, with drying air being blown from the outside into the tubular ware inside in a first zone and evacuated from the inside to the outside in an adjacent second zone, the improvement which comprises p1 (a) three zone means consecutive in the direction of motion of the ware, said zone means being mutually bounded by partition means transverse to the direction of motion of the ware and surrounding the circular expander, and being located in the area of an entry part of said expander spreading the tubular ware and a corresponding exit part of said expander, each of said entry and exit parts being in a substantially common plane with an associated partition means, (b) means magnetically stabilizing the exit part of the circular expander, (c) the zone means located between the entry part and the exit part being designed as a suction chamber and the outer zone means being designed as blowing chambers, and (d) the entry part and the exit part including axial flow openings for the drying air.

5. In drying equipment for tubular textile ware comprising a vertically floating circular expander adapted to spread the tubular ware from the inside, with drying air being blown from the outside into the tubular ware inside in a first zone and evacuated from the inside to the outside in an adjacent second zone, the improvement which comprises (a) three zone means consecutive in the direction of motion of the ware, said zone means being mutually bounded by partition means transverse to the direction of motion of the ware and surrounding the circular expander, and being located in the area of an entry part of said expander spreading the tubular ware and a corresponding exit part of said expander, each of said entry and exit parts being in a substantially common plane with an associated partition means, (b) the zone means located between the entry part and the exit part being designed as a suction chamber and the outer zone means being designed as blowing chambers, (c) the entry part and the exit part including axial flow openings for the drying air, said entry and/or exit part being composed at least partially of a magnetic material, and supporting magnets and/or stabilizing magnets mounted in said partition means surrounding said entry and/or exit parts, and (d) means whereby the width of an air gap between said partition means and said entry and exit parts can be regulated.

* * * * *